US006511392B1

(12) United States Patent
Chohan

(10) Patent No.: US 6,511,392 B1
(45) Date of Patent: Jan. 28, 2003

(54) BASEBALL BAT WITH INTERCHANGEABLE PORTIONS

(76) Inventor: Haroon Chohan, 121-07 101st. Ave., Richmond Hill, NY (US) 11419

( * ) Notice: Subject to any disclaimer, the term of this patent is extended or adjusted under 35 U.S.C. 154(b) by 0 days.

(21) Appl. No.: 09/246,582

(22) Filed: Feb. 8, 1999

(51) Int. Cl.[7] ..... A63B 59/06
(52) U.S. Cl. ..... 473/564; 473/566; 473/567
(58) Field of Search ..... 473/564–568, 473/296, 288, FOR 169, 519, 520, 457

(56) References Cited

U.S. PATENT DOCUMENTS

| | | | | | |
|---|---|---|---|---|---|
| 2,659,605 | A | * | 11/1953 | Le Tourneau | 473/568 |
| 3,516,697 | A | * | 6/1970 | Hahn | 473/296 |
| 3,877,698 | A | * | 4/1975 | Volpe | 473/566 |
| 4,014,542 | A | | 3/1977 | Tanikawa | 273/72 R |
| 4,569,521 | A | | 2/1986 | Mueller | 273/72 A |
| 4,907,800 | A | * | 3/1990 | Passamaneck et al. | 473/457 |
| 5,114,144 | A | | 5/1992 | Baum | 273/72 R |
| 5,460,369 | A | | 10/1995 | Baum | 273/72 R |
| 5,711,728 | A | | 1/1998 | Marcelo | 473/520 |
| 5,820,438 | A | * | 10/1998 | Horton, III | 473/564 |
| 5,827,142 | A | * | 10/1998 | Rappaport | 473/567 |

FOREIGN PATENT DOCUMENTS

| | | | | |
|---|---|---|---|---|
| GB | 2146538 | * | 4/1985 | 473/FOR 169 |
| GB | 16565 | * | 7/2002 | 473/FOR 169 |

* cited by examiner

*Primary Examiner*—Mark S. Graham
(74) *Attorney, Agent, or Firm*—Richard L. Miller

(57) ABSTRACT

A baseball bat with interchangeable portions. The bat includes a handle portion, a head portion, and attaching apparatus. The head portion is interchangeably attached to the handle portion. The attaching apparatus interchangeably attaches the head portion to the handle portion so as to allow for replacement of either the handle portion or the head portion.

21 Claims, 1 Drawing Sheet

BASEBALL BAT WITH INTERCHANGEABLE PORTIONS

BACKGROUND OF THE INVENTION

1. Field of the Invention

The present invention relates to a baseball bat. More particularly, the present invention relates to a baseball bat with interchangeable portions.

2. Description of the Prior Art

Numerous innovations for baseball bats have been provided in the prior art that will be described. Even though these innovations may be suitable for the specific individual purposes to which they address, however, they differ from the present invention.

A FIRST EXAMPLE, U.S. Pat. No. 4,014,542 to Tanikawa teaches a bat of urethane foam used in baseball, which has a metal tube of duralumin at the barrel portion. The metal tube has many apertures therethrough, which are filled with urethane foam to fit the metal tube to the barrel portion because of the expansive quality of the urethane foam. The bat also has an outer layer of a glass fiber cloth which prevents a batter's hands and arms from becoming numb due to the shock caused by batting the ball and transmitted to him through the bat, and also prevents any broken part of the bat from scattering when the bat is broken. The outer layer, moreover, makes the bat sturdy. It is further possible to provide projections on the outer layer to eliminate the possibility of fouling and tipping.

A SECOND EXAMPLE, U.S. Pat. No. 4,569,521 to Mueller teaches a composite baseball bat that has a unique tapered aluminum spar encased in polyurethane foam. The tapered spar is formed by swaging, starting with an aluminum tube whose outer diameter and wall thickness are those for the barrel section of the bat. A tapering portion is swaged to a decreasing outer diameter and increasing wall thickness, which is then constant over the handle portion of the bat. This construction yields far greater stiffness and freedom from objectionable vibrations.

A THIRD EXAMPLE, U.S. Pat. No. 5,114,144 to Baum teaches a wood composite baseball bat that is formed by overlaying a central core of foamed plastic or extruded aluminum with an inner layer of resin-impregnated fiber knitted or woven cloth and then an outer layer consisting of longitudinally extending planks of resin-coated wood veneer. The article is formed by covering the core with the synthetic material impregnated with uncured resin. While the resin impregnating the fibrous material is still unset, the core member is placed within split molds lined with resin-coated strips of wood veneer and the molds are pressed together while the resin is allowed to set to form a unitary mass.

A FOURTH EXAMPLE, U.S. Pat. No. 5,460,369 to Baum teaches a baseball bat or the like that comprises a tube formed with an outer layer of wood veneer covering a layer of fiber reinforced resin, with the tube layers being impregnated with and bonded to one another with a cured resin. The ends of the tube are closed off with caps adhered to the tube by cured resin. The tube may be hollow and may have a foam plastic core with sufficient resiliency to allow the tube to resiliently deform during impact with a baseball. The tube formed by molding over a tubular end which may constitute the foam core or, alternatively, the forming mandrel may be removed after the resin is cured and the resulting cavity filled with foam plastic.

A FIFTH EXAMPLE, U.S. Pat. No. 5,711,728 to Marcelo teaches a new Shock and Vibration Absorbing Ball Bat for absorbing the shock and vibration forces generated when the bate strikes a ball before the forces reach the hands of the batter. The inventive device includes a hitting portion, a handle portion, an intermediate portion between the hitting portion and the handle portion, and a series of knurls provided along the intermediate portion of the bat above the handle portion and below the hitting portion. The knurls are coaxially aligned with the intermediate portion of the bat and define a peripheral wall which has a diameter greater than that of the intermediate portion of the bat immediately adjacent the knurl whereby the knurl is radially enlarged relative to the intermediate portion of the bat immediately adjacent the knurl. In a first embodiment, each of the knurls is a convex knurl wherein the peripheral wall of the convex knurl is convex-shaped. In a second embodiment, each of the knurls is a cylindrical knurl wherein the peripheral wall of the cylindrical knurl is cylindrical-shaped.

It is apparent that numerous innovations for baseball bats have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a baseball bat with interchangeable portions that avoids the disadvantages of the prior art.

ANOTHER OBJECT of the present invention is to provide a baseball bat with interchangeable portions that is simple and inexpensive to manufacture.

STILL ANOTHER OBJECT of the present invention is to provide a baseball bat with interchangeable portions that is simple to use.

BRIEFLY STATED, YET ANOTHER OBJECT of the present invention is to provide a baseball bat with interchangeable portions. The bat includes a handle portion, a head portion, and attaching apparatus. The head portion is interchangeably attached to the handle portion. The attaching apparatus interchangeably attaches the head portion to the handle portion so as to allow for replacement of either the handle portion or the head portion.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

DESCRIPTION OF THE DRAWING

The figures on the drawing are briefly described as follows.

OF REFERENCE NUMERALS UTILIZED IN THE DRAWING

First Embodiment

Figure 1:
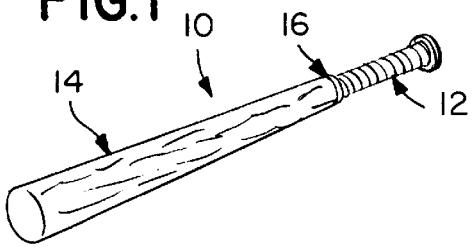
FIG. 1 is a diagrammatic perspective view of a first embodiment of the present invention.

10 baseball bat with interchangeable portions of the present invention
12 handle portion
14 head portion
16 apparatus for interchangeably attaching head portion 14 to handle portion 12 so as to allow for replacement of one of handle portion 12 and head portion 14
18 cushion around handle portion 12 for gripping
20 threaded shaft of apparatus 16
22 blind bore of apparatus 16 bored axially in head portion 14
24 ring of apparatus 16 for tight fit and for compensating for expansion and contraction of dissimilar materials of handle portion 12 and head portion 14

Second Embodiment

110 baseball bat with interchangeable portions of the present invention
112 handle portion
114 head portion
124 collar for adding strength
126 narrow end face of collar 124
128 wide end face of collar 124
130 first bore in narrow end face 126 of collar 124
132 second bore in wide end face 128 of collar 124
134 plurality of splines on second bore 132 in wide end face 128 of collar 124 for providing a snug fit

Third Embodiment

210 baseball bat with interchangeable portions of the present invention
212 handle portion
214 head portion
216 apparatus
220 threaded shaft of apparatus 216
222 blind bore of apparatus 216

DESCRIPTION OF THE PREFERRED EMBODIMENT

Referring now to the figures, in which like numerals indicate like parts, and particularly to FIG. 1, the general configuration of a first embodiment of the baseball bat with interchangeable portions of the present invention is shown generally at 10 and comprises a handle portion 12, a head portion 14 interchangeably attached to the handle portion 12, and apparatus 16 for interchangeably attaching the head portion 14 to the handle portion 12 so as to allow for replacement of one of the handle portion 12 and the head portion 14.

Figure 2:
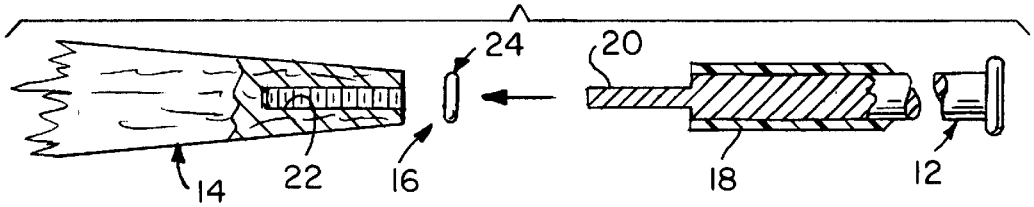
FIG. 2 is an enlarged and exploded diagrammatic cross sectional view of the present invention shown in FIG. 1.

The specific configuration of the baseball bat with interchangeable portions 10 can best be seen in FIG. 2, and as such, will be discussed with reference thereto.

The handle portion 12 is one of machined aluminum and composite.

The handle portion 12 has a cushion 18 therearound for gripping.

The cushion 18 of the handle portion 12 is one of rubber and foam.

The head portion 14 is wood.

The apparatus 16 comprises a threaded shaft 20 that extends axially from the handle portion 12.

The threaded shaft 20 of the apparatus 16 is integrally machined with the handle portion 12 when the handle portion 12 is aluminum.

The threaded shaft 20 of the apparatus 16 is integrally molded with the handle portion 12 when the handle portion 12 is composite.

The apparatus 16 further comprises a blind bore 22 bored axially in the head portion 14 and threadably and interchangeably receives the threaded shaft 20 of the apparatus 16.

The apparatus 16 further comprises a ring 24 that receives the threaded shaft 20 of the apparatus 16 and compresses between the handle portion 12 and the head portion 14 when threaded together for a tight fit and for compensating for expansion and contraction of dissimilar materials of the handle portion 12 and the head portion 14.

The ring 24 of the apparatus 16 is rubber.

Figure 3:
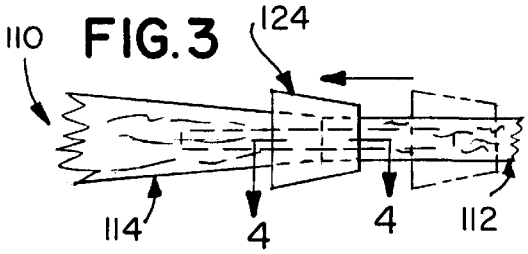
FIG. 3 is an enlarged diagrammatic side elevational view of a second embodiment of the present invention.

The general configuration of a second embodiment of the baseball bat with interchangeable portions 110 can best be seen in FIG. 3, and as such, will be discussed with reference thereto.

The baseball bat with interchangeable portions 110 is similar to the baseball bat with interchangeable portions 10, except that the handle portion 112 is one of wood and composite, the head portion 114 is aluminum, the ring 24 is deleted, and a collar 124 compressibly engages both a portion of the handle portion 112 and an adjacent portion of the head portion 114 where the head portion 114 is threaded directly against the handle portion 112 for adding strength thereat.

The collar 124 remains on the handle portion 112 and when the head portion 114 has been threaded onto the handle portion 112, is tapped to slide onto the portion of the head portion 114 and thereby compressing thereagainst.

Figure 4:
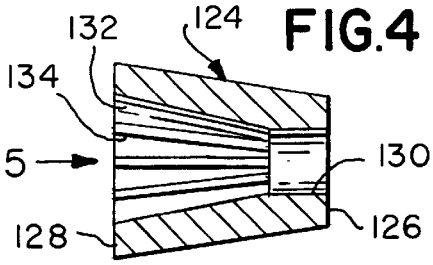
FIG. 4 is an enlarged diagrammatic cross sectional view taken on line 4—4 in FIG. 3 of the collar of the second embodiment of the present invention.
Figure 5:
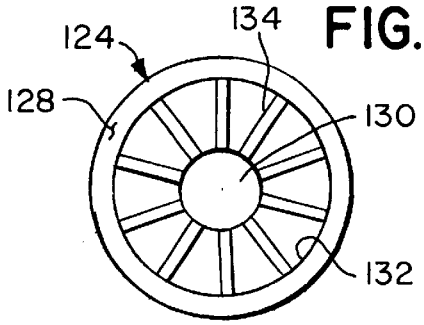
FIG. 5 is an enlarged diagrammatic end elevational view taken generally in the direction of arrow 5 in FIG. 4.

The specific configuration of the collar 124 can best be seen in FIGS. 4 and 5, and as such, will be discussed with reference thereto.

The collar 124 is one of aluminum and composite.

The collar 124 is conically-frustrum-shaped and has a narrow end face 126 and a wide end face 128 that is wider than the narrow end face 126 of the collar 124.

The narrow end face 126 of the collar 124 has a first bore 130 that is cylindrically-shaped and extends axially therein and snugly receives the portion of the handle portion 112.

The wide end face 128 of the collar 124 has a second bore 132 that is conically-frustrum-shaped and extends axially and taperingly therein to and communicates with the first bore 130 in the narrow end face 126 of the collar 124 and snugly receives the portion of the head portion 114.

The second bore 132 in the wide end face 128 of the collar 124 has a plurality of splines 134 that extend axially and completely therealong for providing a snug fit.

Figure 6:
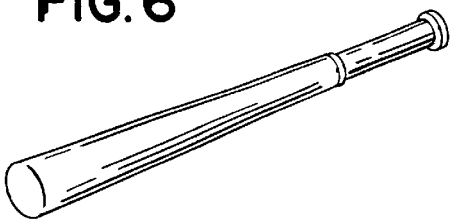
FIG. 6 is a diagrammatic perspective view of a third embodiment of the present invention.
Figure 7:
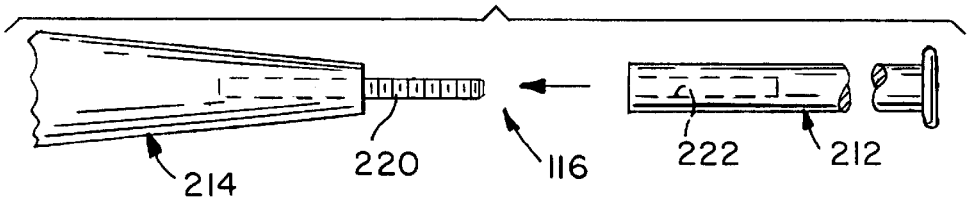
FIG. 7 is an enlarged and exploded front elevational view of the third embodiment of the present invention shown in FIG. 6.

The specific configuration of a third embodiment of the baseball bat with interchangeable portions 210 can best be seen in FIGS. 6 and 7, and as such, will be discussed with reference thereto.

The baseball bat with interchangeable portions 210 is similar to the baseball bat with interchangeable portions 10, except that the threaded shaft 220 of the apparatus 216 extends axially from the head portion 214 and the blind bore 222 of the apparatus 216 is bored axially in the handle portion 212.

It will be understood that each of the elements described above, or two or more together, may also find a useful application in other types of constructions differing from the types described above.

While the invention has been illustrated and described as embodied in a baseball bat with interchangeable portions, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A baseball bat with interchangeable portions, comprising:

a) a handle portion;

b) a head portion interchangeably attached to said handle portion; and c) means for interchangeable attaching said head portion to said handle portion so as to allow for replacement of one of said handle portion and said head portion, wherein said means includes a collar that compressibly engages both a portion of said handle portion and an adjacent portion of said head portion where said head portion is threaded directly against said handle portion for adding strength thereat, wherein said collar of said means is conically-frustrum-shaped and has:

i) a narrow end face; and ii) a wide end face that is wider than said narrow end face of said collar of said means, wherein said narrow end face of said collar of said means has a first bore that is cylindrically-shaped and extends axially therein and snugly receives said portion of said handle portion, wherein said wide end face of said collar has a second bore that is conically-frustrum-shaped and extends axially and taperingly therein to and communicates with said first bore in said narrow end face of said collar of said means and snugly receives said portion of said head portion.

2. The bat as defined in claim 1, wherein said handle portion is machined aluminum.

3. The bat as defined in claim 1, wherein said handle portion is composite.

4. The bat as defined in claim 1, wherein said handle portion has a cushion therearound for gripping.

5. The bat as defined in claim 4, wherein said cushion of said handle portion is rubber.

6. The bat as defined in claim 4, wherein said cushion of said handle portion is foam.

7. The bat as defined in claim 1, wherein said head portion is wood.

8. The bat as defined in claim 1, wherein said means includes a threaded shaft that extends axially from said handle portion.

9. The bat as defined in claim 8, wherein said threaded shaft of said means is integrally machined with said handle portion when said handle portion is aluminum.

10. The bat as defined in claim 8, wherein said threaded shaft of said means is integrally molded with said handle portion when said handle portion is composite.

11. The bat as defined in claim 8, wherein said means further includes a blind bore bored axially in said head portion and threadably and interchangeably receives said threaded shaft of said means.

12. The bat as defined in claim 8, wherein said means further includes a ring that receives s aid threaded shaft of said means and compresses between said handle portion and said head portion when threaded together for a tight fit and for compensating for expansion and contraction of dissimilar materials of said handle portion and said head portion.

13. The bat as defined in claim 12, wherein said ring of said means is rubber.

14. The bat as defined in claim 1, wherein said handle portion is wood.

15. The bat as defined in claim 1, wherein said head portion is aluminum.

16. The bat as defined in claim 1, wherein said collar of said means remains on said handle portion and when said head portion has been threaded onto said handle portion, is tapped to slide onto said portion of said head portion and thereby compressing thereagainst.

17. The bat as defined in claim 1, wherein said collar of said means is aluminum.

18. The bat as defined in claim 1, wherein said collar of said means is composite.

19. The bat as defined in claim 1, wherein said second bore in said wide end face of said collar of said means has a plurality of splines that extend axially and completely therealong for providing a snug fit.

20. The bat as defined in claim 1, wherein said means includes a threaded shaft that extends axially from said head portion.

21. The bat as defined in claim 20, wherein said means further includes a blind bore that is bored axially in said handle portion and threadably and interchangeably receives said threaded shaft of said means.

* * * * *